United States Patent [19]

Moriguchi et al.

[11] Patent Number: 4,476,209

[45] Date of Patent: Oct. 9, 1984

[54] SELENIUM-ANTIMONY ALLOY ELECTROPHOTOGRAPHIC PHOTORECEPTORS

[75] Inventors: Hiroyuki Moriguchi, Hachioji; Takeo Shimura, Ohtsuki; Tadashi Kaneko, Sagamihara; Hiroyuki Nomori; Akira Nishiwaki, both of Hachioji, all of Japan

[73] Assignee: Konishiroku Photo Industry Co., Ltd., Tokyo, Japan

[21] Appl. No.: 418,680

[22] Filed: Sep. 16, 1982

[30] Foreign Application Priority Data

Sep. 21, 1981 [JP] Japan ..... 56-147791

[51] Int. Cl.[3] ..... G03G 5/082

[52] U.S. Cl. ..... 430/95; 430/84; 430/62; 430/128

[58] Field of Search ..... 430/84, 85, 86, 58, 430/62, 95, 128

[56] References Cited

U.S. PATENT DOCUMENTS 2,962,376 11/1960 Schaffert ..... 430/84

3,904,408 9/1975 Hanada et al. ..... 430/85

*Primary Examiner*—John E. Kittle

*Assistant Examiner*—John L. Goodrow

*Attorney, Agent, or Firm*—Jordan B. Bierman

[57] ABSTRACT

An electrophotographic photoreceptor comprising a conductive layer and a photosensitive layer of vapor-deposited selenium-antimony alloy film formed thereon is disclosed. The photosensitive layer has an average antimony concentration of 5 to 21 wt % and the center layer thereof except for the skin layer on either side has a change in antimony concentration within 2 wt % in any region that is 1000 deep Å from the surface of the skin layer.

7 Claims, 8 Drawing Figures

SELENIUM-ANTIMONY ALLOY ELECTROPHOTOGRAPHIC PHOTORECEPTORS

FIELD OF THE INVENTION

The present invention relates to an electrophotographic photoreceptor.

BACKGROUND OF THE INVENTION

Electrophotographic photoreceptors generally consist of an electrically conductive base and a photoconductive photosensitive layer, which is required to have (1) great charge-retaining ability, (2) great image-forming ability and (3) high stability. The charge-retaining ability is the ability of the photosensitive layer to retain positive or negative ions produced by corona discharge in the charging step of electrophotographic processing, and the photosensitive layer must have great electrical resistance to exhibit great charge-retaining ability. The image-forming ability is the ability of the photoconductive material in the photosensitive layer to form an electrostatic latent image corresponding to the pattern of light illumination given to erase the charges produced in the charging step, and the photosensitive layer must have good spectral sensitivity characteristics to exhibit great image-forming ability. The term "stability" means both the electrical stability of the photosensitive layer against repeated use of the photoreceptor and the environmental stability against heat, light, etc.

Amorphous selenium is commonly employed as a photoconductive material in the photosensitive layer of conventional electrophotographic photoreceptors, because selenium has high electrical resistance and stability. Another reason is that the defects of pure selenium, i.e. difficulty in achieveing good spectral sensitivity characteristics and environmental stability (amorphous selenium is easily crystallized with heat), can be eliminated to some extent by adding suitable impurities. It is known that good spectral sensitivity characteristics can be obtained by adding tellurium or arsenic, and electrophotographic photoreceptors having a photosensitive layer made of such photoconductive composition are being used in industry. But a photosensitive layer made of tellurium-doped selenium has a primarily chained amorphous structure, and at fairly low temperatures (ca. 50° C.) it is crystallized to lose its charge-retaining ability. On the other hand, a photosensitive layer made of arsenicdoped selenium has a three-coordinate amorphous structure, so it can have a fairly high thermal stability, but since it contains arsenic, it involves a potentially great hazard in its production or subsequent handling. Another impurity that is added to selenium to increase its spectral sensitivity characteristics is antimony as described in U.S. Pat. No. 3,490,903. But commerically available photoreceptors having photosensitive layers of this type contain only a very small amount of antimony, and no commercial photoreceptor that has a photosensitive layer containing a fairly high concentration of antimony has yet been made.

Photosensitive layers made of vapor-deposited films of selenium-antimony alloy cannot have the desired electrophotographic characteristics (e.g. sensitivity, dark resistance and residual potential characteristics) or great resistance to heat and wear unless the concentration of antimony is satisfactorily high, say, 5 wt% or more. The deposited film of selenium-antimony alloy is preferably formed by using the alloy as a starting material, as in the case of depositing selenium-tellurium or selenium-arsenic alloy film. But except for an alloy having a stable structure (e.g. $Sb_2Se_3$) or a structure close to it (with an antimony concentration of about 50 wt%), vapor deposition using a selenium-antimony alloy has one great problem in that selenium is always evaporated preferentially at low temperatures to cause a change in the antimony concentration. For instance, to form a vapor-deposited photosensitive layer of an alloy having an antimony concentration of 5 to 21 wt% that is desired as electrophotographic characteristics, the alloyed starting material must be heated to 550° C. or higher, but as the alloy is heated, only selenium starts to be evaporated at about 300° C., and the antimony concentration fluctuates at various states of the vapor deposition, with the result that no desired film is obtained.

This problem can be solved by evaporating selenium and antimony from separate sources so as to form a vapor-deposited film of selenium-antimony alloy on the same substrate. This method enables the formation of a selenium-antimony photoconductor with high antimony concentration by vapor-depositing the alloy film on the surface of a stationary conductive plate with a small area. But a commerical electrophotographic photoreceptor must be in a sheet form of large area or it must be of drum type. If a photosensitive layer having a fairly high antimony concentration is formed on a large sheet with a conductive layer or on a conductive drum by evaporating selenium and antimony from separate sources, an electrophotographic photoreceptor exhibiting good sensitivity and charging characteristics over an extended period cannot be obtained. This defect is particularly serious in a drum type photoreceptor which experiences so great a fluctuation in antimony concentration that it has low sensitivity while causing a great buildup of residual potential. A photoreceptor having a selenium-antimony photosensitive layer containing antimony at a fairly high concentration, say, 5 to 21 wt% is described in the above-mentioned U.S. Pat. No. 3,490,903, but it has not always been possible to produce the desired photoreceptor consistently with high productivity by simply specifying the antimony concentration.

SUMMARY OF THE INVENTION

Therefore, one object of the present invention is to provide an electrophotographic photoreceptor that has a photosensitive layer of selenium-antimony alloy with a fairly high antimony concentration and which also has good characteristics, i.e. high sensitivity and low residual potential.

Another object of the invention is to provide an electrophotographic photoreceptor that has good characteristics and which also has a photosensitive layer of vapor-deposited selenium-antimony alloy film with a fairly high antimony concentration that can be formed with minimum hazard to workers.

A further object of the invention is to provide an electrophotographic photoreceptor that has good characteristics and which also has a photosensitive layer of vapor-deposited selenium antimony alloy film with a fairly high antimony concentration that has high crystallization temperature and whose characteristics are little impaired during repeated use.

Yet a further object of the invention is to provide an electrophotographic photoreceptor that has a photosensitive layer of selenium-antimony alloy with a fairly high antimony concentration and which exhibits good characteristics (i.e. high sensitivity and low residual potential) over an extended period.

Still another object of the invention is to provide an electrophotographic photoreceptor that has good characteristics (high sensitivity and low residual potential) and which also has a photosensitive layer of selenium-antimony alloy with a fairly high antimony concentration that can be produced with high productivity.

A still further object of the invention is to provide an electrophotographic photoreceptor that has a photosensitive layer of selenium-antimony alloy with a fairly high antimony concentration and which has great latitude in its application to electrophotographic processing and which also has good characteristics.

These objects of the present invention can be achieved by forming on a conductive support a photosensitive layer of vapor-deposited selenium-antimony alloy film that has an average antimony concentration of 5 to 21 wt% and wherein a center layer of the photosensitive layer (except for the skin layer on either side) has a difference in change in antimony concentration within 2 wt% in the microscopic region 1000 Å deep vertically from any point in the center layer.

DETAILED DESCRIPTION OF THE INVENTION

The photoreceptor of the present invention is hereunder described in detail by reference to the accompanying drawings, wherein.

Figure 1:
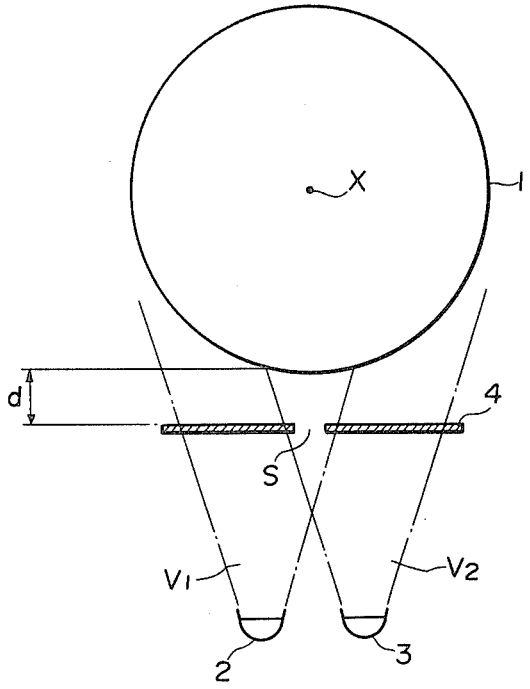
FIG. 1 is a schematic representation of one method for making the photoreceptor of the present invention.
Figure 3:
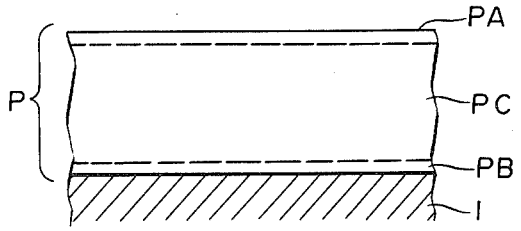
FIG. 3 shows schematically one embodiment of the photosensitive layer of the photoreceptor.
Figure 2:
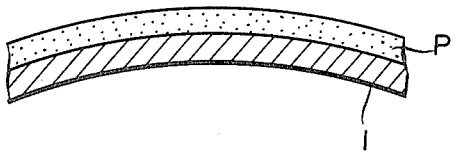
FIG. 2 is a cross-sectional view that schematically shows the photoreceptor of the present invention.

In FIG. 1, a conductive drum 1 is supported rotatably around a horizontal central shaft X, and a first evaporation source 2 for selenium or selenium alloy is placed in a side-by-side relation with a second evaporation source 3 for antimony or antimony alloy. The two evaporation sources are positioned beneath the drum 1 in a face-to-face relation and the first source has an evaporation area V1 that overlaps with an evaporation area V2 provided by the second source. A slitted plate 4 is placed between the drum and the evaporation sources 2 and 3 in such a manner that a slit S is positioned in the center of the overlapping portion of the areas V1 and V2. As the drum 1 is rotated, the first and second evaporation sources are heated simultaneously to deposit the vapor of an intimate mixture of selenium and antimony on the drum 1 through a controlled width of the slit S. This method enables the formation of a photosensitive layer P as shown in FIG. 2 wherein the difference in change in antimony concentration in the center layer that is 1000 Å deep vertically from any point therein is within 2 wt% and achieves the objects of the present invention. But the antimony concentration of the skin layer PA exposed to atmosphere and the skin layer PB (see FIG. 3) that contacts the drum 1 is generally changed by a degree of more than 2 wt%, due both to air and the oxide in the drum surface, as soon as the selenium-antimony photosensitive layer P is formed. But this phenomenon little affects the advantages of the present invention (which will be described later) if the thickness of each skin layer is not more than 1000 Å, and the actually produced skin layers PA and PB generally have a thickness of not more than about 500 Å.

The distribution of the antimony concentration over the area 1000 Å deep vertically from any point in the center layer can be determined by measuring the antimony concentration in many, say 100 points of the photosensitive center layer PC. For measurement of the antimony concentration, a known X-ray photoelectro-analyzer "ESCA 750" may be used, and such measurement may be effected several times. The degree of variation in antimony concentration may be determined by measuring the difference between the maximum and minimum concentrations. Preferably, the average antimony concentration for the entire part of the photosensitive layer P is between 7 and 15 wt%.

As described above, the photoreceptor of the present invention has a photosensitive layer of selenium-antimony alloy that has an average antimony concentration of 5 to 21 wt% and wherein the center layer of the photosensitive layer has a difference in change in antimony concentration within 2 wt% in the microscopic region 1000 Å deep vertically from any point in the center layer. For these characteristics, the photoreceptor has high sensitivity, a very low residual potential and a high crystallization temperature and it yet can be produced consistently with high productivity. These advantages of the photoreceptor of the present invention will become apparent by reading the Examples that are described hereinafter. It is surprising and unobvious from the conventional art that a high-performance drum type photoreceptor having a selenium-antimony photosensitive layer with a fairly high antimony concentration can be produced consistently with high productivity by controlling the change in the antimony concentration of a very small cross-sectional area of the photosensitive layer. If the difference in change in the antimony concentration of any region of the photosensitive center layer PC that is 1000 Å deep vertically from any point therein exceeds 2 wt%, the intended advantages of the present invention are not always obtained, and a photoreceptor having low sensitivity and high residual potential may often result.

Figure 4:
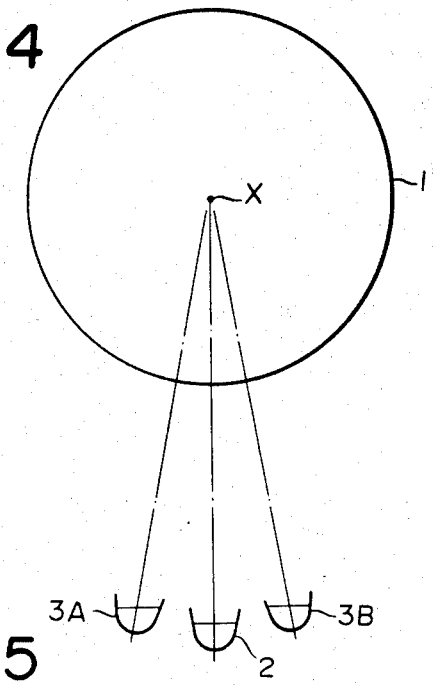
FIG. 4 is a schematic representation of another method for making the photoreceptor of the present invention.

It is essential that the photosensitive layer P be formed from separate evaporation sources 2 and 3. In the embodiment already described, the slitted plate 4 is used to avoid the formation of an evaporation space that will cause a great change in antimony concentration. Another method that is effective in forming the photosensitive layer P is shown in FIG. 4 wherein two second evaporation sources 3A and 3B are positioned symmetrically with respect to an adjacent first evaporation source 2, or alternatively two first evaporation sources are positioned symmetrically with respect to an adjacent second evaporation source, and the two symmetrical evaporation sources are inclined so that their respective axes pass through the center shaft X of the drum 1 to deposit the vapor of an intimate mixture of the three evaporation sources on the surface of the drum. More effectively, the slitted plate 4 may be combined with this alternative method.

Figure 5:
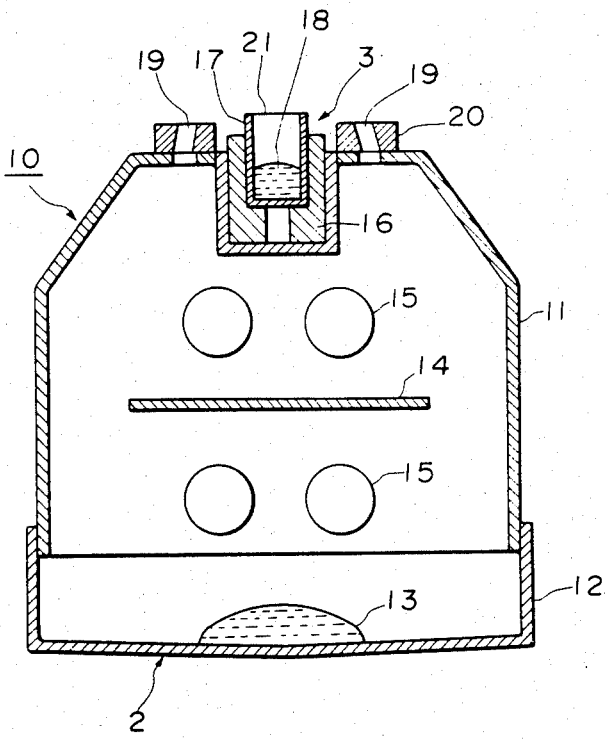
FIG. 5 is a cross-sectional view that schematically shows a vapor deposition apparatus that is preferably used for making the photoreceptor of the present invention.

FIG. 5 shows schematically a binary apparatus 10 that is capable of effecting the desired vapor deposition by the same operating theory illustrated in FIG. 4. The apparatus 10 includes a housing 11 having a first detachable container 12 that makes the bottom of the housing 11 and which also serves as a first evaporation source 2 filled with a first vaporizable material 13 made of selenium or its alloy. A plate 14 to prevent the drifting of coarse particles is placed above the first evaporation source 2 and two heaters 15 (for infrared lamps) are placed both above and below the plate 14. A small boat-like container 17 that is isolated from the inner space of the housing 11 through an electrical insulator 16 is positioned in the center of the top of the housing 11 and this container 17 serves as a second evaporation source 3 that is filled with a second vaporizable material 18 made of antimony or its alloy. The second vaporizable material 18 is heated by the Joule heat produced by, say, applying a current between electrodes at both ends of the container 17. On each side of the second evaporation source 3 is disposed a discharge port member 20 having an opening 19 through which the vapor of the first evaporation source 2 is discharged from the housing 11. The opening 19 is slightly inclined so that an extension of its center axis crosses the center line of the container 17. Each evaporation source has a thermocouple (not shown) or other suitable means to control the evaporation rate.

In the arrangement described above, the second evaporation source 3 filled with the second vaporizable material 18 having a higher melting point is positioned above the first evaporation source 2 filled with the first vaporizable material 13 having a lower melting point, so the temperature of heating the second evaporation source 3 can be controlled precisely without being directly influenced by the temperature of heating the first evaporation source 2, with the result that the rate of evaporation from the two sources 2 and 3 can be accurately controlled. As another advantage, the opening 19 through which the vapor of the first evaporation source 2 is ejected is positioned close to each side of opening 21 which is an outlet for the vapor of the second evaporation source 3, and this provides a very effective tool for producing the desired photosensitive layer of the present invention.

The photoreceptor of the present invention uses a photosensitive layer that is formed by depositing the vapor of selenium or antimony which is by no means toxic to human beings, so the desired product can be manufactured without involving any potential hazard to workers. Furthermore, the selenium-antimony alloy is very stable since it has a three-dimensional structure, is not crystallized at elevated temperatures, and its characteristics are little impaired as a result of repeated use.

Figure 6:
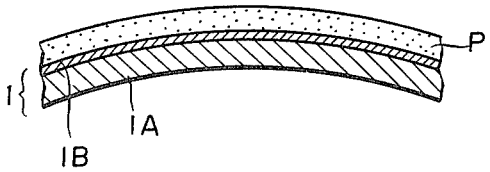
FIGS. 6 and 7 are cross-sectional views that show schematically other embodiments of the photosensitive layer of the photoreceptor.
Figure 7:
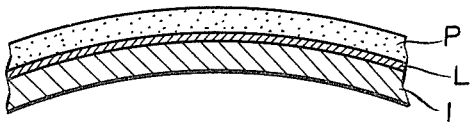

The conductive drum 1 may be made of metal such as aluminum, nickel, copper, zinc, palladium, silver, indium, tin, platinum, gold, stainless steel or brass. Alternatively, the drum 1 may be composed of an insulating drum 1A having a coat of conductive layer 1B as shown in FIG. 6. The conductive layer 1B may be formed on the drum 1A by laminating a metal coat, vacuum-depositing the vapor of a metal, or by any other suitable method. If necessary, an intermediate layer L may be provided between the conductive drum 1 and the photosensitive layer P as shown in FIG. 7. The intermediate layer L may be formed by (a) chemically treating the surface of the drum 1, or it may be made of (b) an inorganic material or (c) an organic material. Typical examples of the material for the intermediate layer L include aluminum oxide, tin oxide, germanium, silicon, lead sulfide, polycarbonate resin, phenolic resin, acrylic resin and polyvinyl carbazole. The intermediate layer L functions as both an adhesive layer and a barrier layer between the drum 1 and the photosensitive layer P.

The above described method of vapor deposition may be combined with additional treatments. For instance, th vapor-deposited film forms easily a trap level depending upon the specific method of vapor deposition and dopants; the trap level captures charges produced by light illumination and inhibits their movement, and as a result, the photosensitive layer may have a high residual potential. This problem can be solved by eliminating the trap level with a halide atom such as chlorine, bromine or iodine or a metal atom such as lithium, sodium, potassium, rubidium, indium or thallium which is introduced in the deposited film. Other techniques that can be combined with the vapor deposition are that of controlling the temperature of the substrate according to the composition of the evaporation source, and that of heat-treating the deposited film to form a photosensitive layer having physical and chemical stabilities. Other examples include increasing the antimony concentration of the skin layer to provide the photosensitive layer P with increased photosensitivity, forming a topcoat comprising selenium to provide higher electrical resistance, and forming an undercoat comprising selenium to prevent transfer of charges from the drum 1 or intermediate layer L.

The thickness of the photosensitive layer P varies with the specific conditions under which it is used, but generally, it is in the range of from 10 to 200 microns, preferably from 50 to 100 microns.

As described in the foregoing, the present invention provides an electrophotographic photoreceptor that has great charge retaining ability due to high electrical resistance, and which also has great image-forming ability due to good spectral sensitivity characteristics, and which always produces a desired electrophotographic product in spite of cyclic use (due to great electrical stability and environmental stability, against heat in particular).

The present invention is now described in greater detail by reference to the following examples which are given here for illustrative purposes only and are by no means intended to limit the scope of the invention.

EXAMPLE 1

An aluminum drum 1 whose surface had been oxidized was placed 25 cm high above a first evaporation source 2 filled with selenium and a second evaporation source 3 filled with antimony. A slitted plate 4 was positioned 1 cm below the drum 1. As the drum 1 was rotated at 20 rpm and the temperature held at 70° C., the first evaporation 2 was heated at 310° C. and the second evaporation source at 570° C. for 60 minutes to deposit the vapor of an intimate mixture of selenium and antimony on the drum. Five photoreceptor samples with deposited vapor films were made by changing the width of the slit S in plate 4 as indicated in the following table. The characteristics of each sample were evaluated by an electrophotocopier "U-Bix V" (product of Konishiroku Photo Industry Co., Ltd.) with a surface potential meter Model 144 of Monroe Auto Equipment Company. The results are also shown in the following table.

TABLE

| Photoreceptor Sample No. | | 1 | 2 | 3 | 4 | 5 |
|---|---|---|---|---|---|---|
| Slit Width (cm) | | 5 | 6 | 7 | 10 | 15 |
| Antimony Concentration (wt %) | Max. | 10.3 | 10.7 | 10.9 | 11.2 | 13.2 |
| | Min. | 9.5 | 9.2 | 9.0 | 8.7 | 7.0 |
| Black Paper Potential (V) | | 720 | 700 | 710 | 670 | 700 |
| White Paper Potential (V) | | 70 | 80 | 100 | 250 | 400 |
| Residual Potential (V) | | 10 | 10 | 20 | 170 | 350 |
| Rating | | O | O | ○ | Δ | X |

The values in the column of "antimony concentration" are those antimony concentrations in the area 1000 to 2000 Å deep vertically from any point in the photosensitive center layer which were measured with an X-ray photoelectro-analyzer "ESCA 750" of Shimadzu Corporation. The values in the columns of "black paper potential" and "white paper potential" are those of surface potential which were obtained by exposing a black paper (reflection density: 1.3) original and a white paper (0.0) original, respectively to illumination. The values in the column of "residual potential" are those of surface potential which were measured after exposure with a neutralizing lamp.

The data on "antimony concentration" in the table shows the result of measurements for typical areas of the photosensitive layer. Similar measurements were conducted for other parts of the area 1000 Å deep vertically from any point in the photosensitive center layer and the results were as follows: photoreceptor sample No. 1 had a maximum change in antimony concentration of 0.9 wt%, sample No. 2 had a maximum of 1.6 wt%, sample No. 3 had a maximum of 2.0 wt%, sample No. 4 had a maximum of 2.7 wt%, and sample No. 5 had a maximum of 6.4 wt%.

As is clear from these results, a good photoreceptor for electrophotography having high charge retaining ability, image forming ability and stability can be produced if the difference in change in antimony concentration in the photosensitive center layer is within 2 wt%.

EXAMPLE 2

Figure 8:
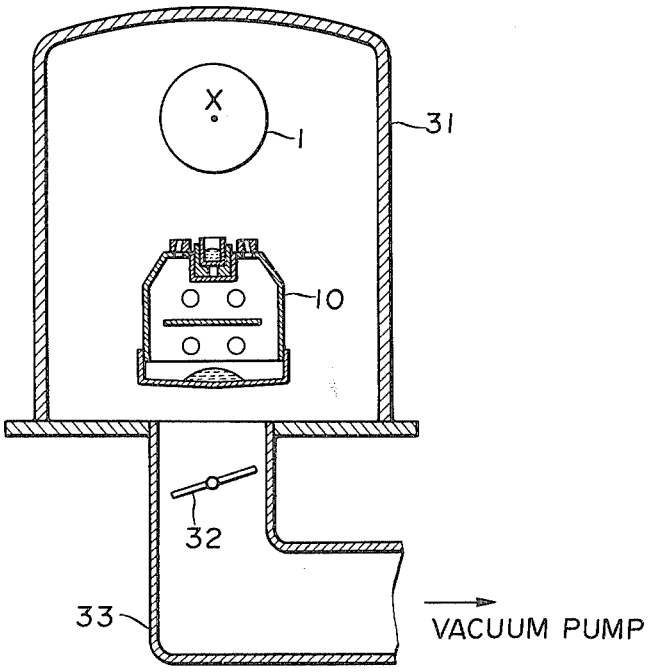
FIG. 8 shows schematically the apparatus used in Examples 1 and 2 of the present invention.

A bell jar 31 as shown in FIG. 8 was evacuated to $10^{-5}$ Torr with a vacuum pump (not shown) through an evacuation channel with a butterfly valve 32. A conductive aluminum drum 1 having a diameter of 10 cm that rotated around a horizontal center shaft X was placed in the upper part of the bell jar 31. A vapor deposition apparatus of the type shown in FIG. 5 was placed 15 cm below the drum 1, and a first evaporation source 2 filled with selenium was heated to about 300° C. with heaters 15 while a second evaporation source 3 filled with antimony was heated to about 560° C. by applying a current of 150 A between electrodes on a container 17 for the second evaporation source. The drum 1 was rotated at 15 rpm as it was held at 75° C. by supplying warm water to the interior of the drum. By this procedure, the vapor of an intimate mixture of selenium and antimony was deposited on the drum to form a photoreceptor having a photosensitive layer 60μ thick.

The photosensitive layer had an average antimony concentration of 10 wt%. Measurement with "ESCA 750" showed that the maximum difference in change in antimony concentration was 0.8 wt% except for the skin layer on either side that was 600 Å deep from the vertically from any point in the photosensitive center layer. The photoreceptor was subjected to corona discharge at 5.4 kV and after a dark decay period, it required an exposure of 0.9 lux. sec for the potential to be decreased by half. When it was later subjected to full-frame exposure (10 lux. sec), there was no residual potential. The photoreceptor was then subjected to a copying test with a U-Bix and 100,000 good copies could be produced without interruption.

As demonstrated by the above data, the present invention provides a drum type electrophotographic photoreceptor that has a photosensitive layer of vapor-deposited selenium-antimony alloy film and which has high sensitivity and low residual potential. The photoreceptor presents no potential hazard to workers during its production, and since it has a high crystallization temperature, its characteristics remain substantially constant at elevated temperatures.

What is claimed is:

1. An electrophotographic photoreceptor comprising a conductive support and a photosensitive layer consisting of a vapor-deposited selenium-antimony alloy film formed thereon, said photosensitive layer having an average antimony concentration of 5 to 21 weight percent and consisting of a center layer and a skin layer on either side of said center layer wherein said antimony concentration within said center layer is maintained within 2 weight % of said average antimony concentration and said center layer is a microscopic region.

2. A photoreceptor according to claim 1 wherein said microscopic region is 1000 Å deep in the vertical direction of said conductive support.

3. A photoreceptor according to claim 1 or 2, wherein said photoreceptor is drum-shaped.

4. A photoreceptor according to claim 1 or 2 wherein said photosensitive layer has an average antimony concentration of between 7 and 15 wt%.

5. A photoreceptor according to claim 3, wherein said conductive support further comprises an insulating support and a conductive layer thereon.

6. A photoreceptor according to claim 3, wherein said photoreceptor further comprises an intermediate layer between the conductive support and the photosensitive layer.

7. A photoreceptor according to claim 3 wherein said photosensitive layer has an average antimony concentration of between 7 and 15 wt%.

* * * * *